United States Patent [19]

Hoffmann, Sr.

[11] Patent Number: 4,835,925

[45] Date of Patent: Jun. 6, 1989

[54] FLEXIBLE CORNER BEAD STRIP

[75] Inventor: Dennis Hoffmann, Sr., Hoffman Estates, Ill.

[73] Assignee: PRO Patch Systems, Inc., Palatine, Ill.

[21] Appl. No.: 197,522

[22] Filed: May 23, 1988

Related U.S. Application Data

[63] Continuation-in-part of Ser. No. 88,796, Aug. 24, 1987, abandoned.

[51] Int. Cl.[4] ..... E04F 19/02; E04F 13/06

[52] U.S. Cl. ..... 52/288; 52/416

[58] Field of Search ..... 52/125.2, 173, 287, 52/288, 416, 417, 254

[56] References Cited

U.S. PATENT DOCUMENTS

| | | | |
|---|---|---|---|
| 2,590,846 | 4/1952 | Cutting | 428/131 |
| 2,599,359 | 6/1952 | Banks et al. | 428/40 |
| 2,862,264 | 12/1958 | Perna | 20/74 |
| 3,086,328 | 4/1963 | Peterson et al. | 52/417 |
| 3,270,473 | 9/1966 | Smith | 52/173 |
| 3,444,657 | 5/1969 | Swanson | 52/417 |
| 3,445,052 | 5/1969 | Lewallen | 52/631 |
| 3,643,393 | 2/1972 | Pierce et al. | 52/287 |
| 3,900,550 | 8/1975 | Oliver et al. | 264/295 |

*Primary Examiner*—James L. Ridgill, Jr.
*Attorney, Agent, or Firm*—Allegretti & Witcoff, Ltd.

[57] ABSTRACT

The present invention is directed to an improved flexible corner bead strip usable for reinforcing a drywall corner. The corner bead strip comprises first and second plastic strips each of which has a substantial longitudinal dimension and corresponding with the length of the drywall corner to be reinforced. Each of the first and second plastic strips also has a transverse dimension which defines a corner line formed from the respective central and abutting edges thereof. A flexible joint is disposed at the respective central and abutting edges of the first and second plastic strips forming a corner line. The corner line functions to substantially flexibly secure the first and second plastic strips together and permits the first and second plastic strips to be bent at an angle corresponding with the angle of the drywall corner for securement thereto, thereby to reinforce the drywall corner. An adhesive layer is also disposed on at least one side of the first and second plastic strips. A drywall compound adhering surface is also contained upon at least one side of the first and second plastic strips.

17 Claims, 1 Drawing Sheet

FIG. 1
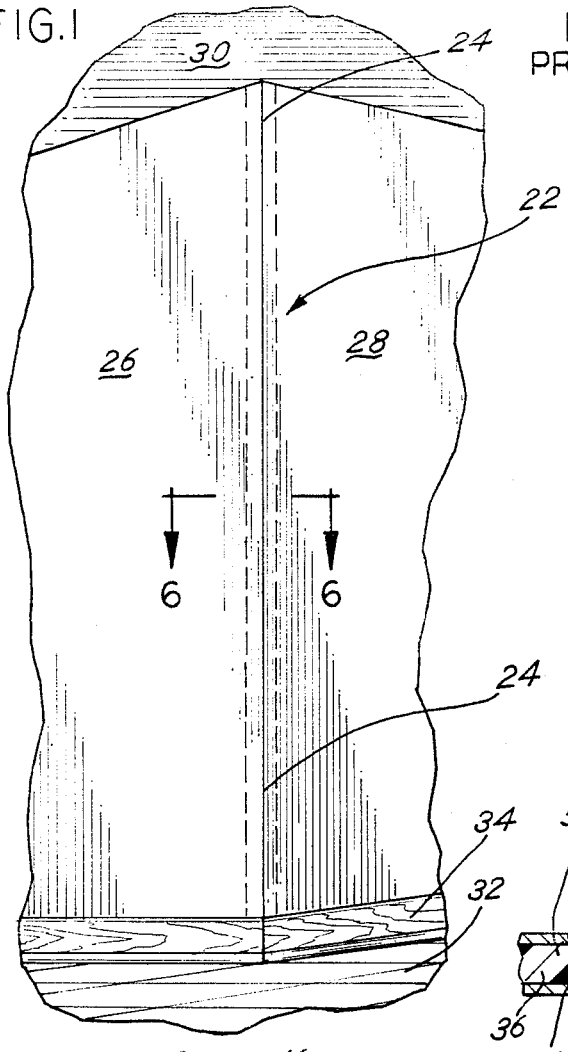
FIG. 2
PRIOR ART
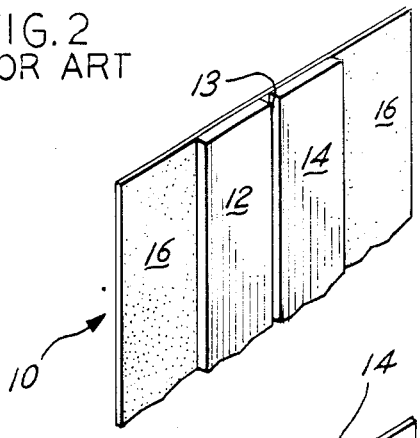
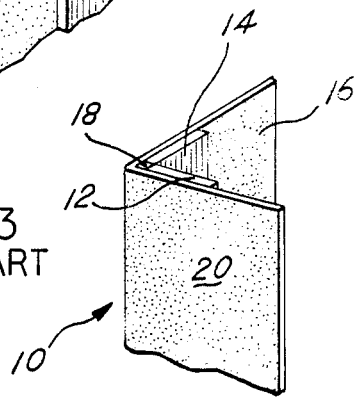
FIG. 3
PRIOR ART
FIG. 5
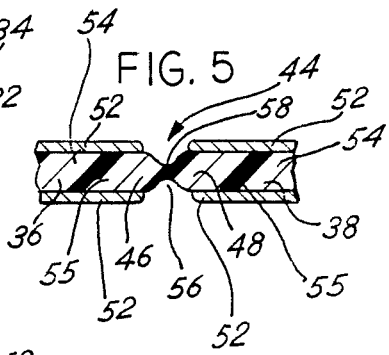
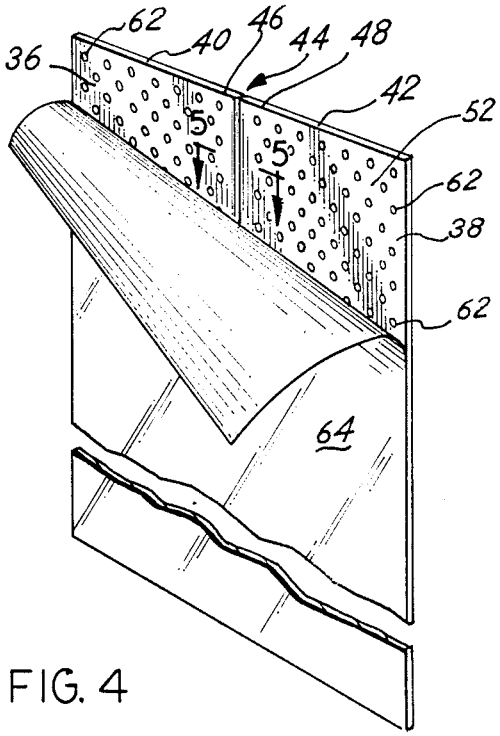
FIG. 4
FIG. 6
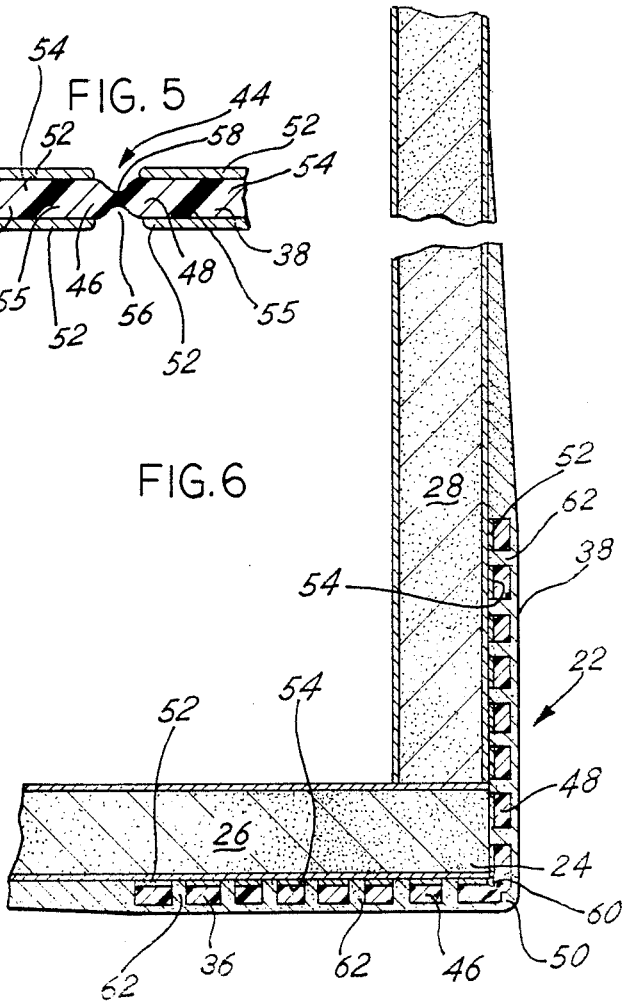

FLEXIBLE CORNER BEAD STRIP

BACKGROUND OF THE INVENTION

This application is a continuation-in-part application of Ser. No. 088,796 filed on Aug. 24, 1987 now abd. The present invention is directed in general to the drywall and the drywall application arts, and more particularly to an improved flexible corner bead strip for reinforcing a drywall corner.

One embodiment of corner bead reinforcing strips of the prior art in is set forth in U.S. Pat. No. 2,862,264 to Anthony Perna and is entitled "Reinforcement Strip For Reinforcing The Corners Of Drywalls And The Like". The reinforcement strips set forth in the prior art comprise two metallic strips formed of galvanized steel or aluminum and disposed side-by-side and with a narrow space therebetween. Such galvanized steel strips are borne upon and connected together by means of a carrier strip of heavy craft paper or fabric which is approximately 2 inches wide. Thus, the prior art reinforcement strip is flexible and may be bent at any angle between apprixunately 270° or to less than 90°, and provides a number of advantages over yet prior art devices.

Nonetheless, there are a number of disadvantages associated with the structure ot prior art reinforcement strips. One such problem is occasioned by the fact that the prior art device is necessarily an at least 3-piece structure. First, additional machinery, care and expense is involved because of the multiple steps necessary to produce and assemble the component parts of such prior art devices. Also, for example, the adhesive utilized to secure the galvanized steel reinforcing strips to the carrier strip of paper or fabric has a tendency to delaminate, either prior to application of such prior art device onto a corner for reinforcement thereof or after-wards, which renders application of drywall compound thereto difficult, inaccurate, messy and time-consuming—all of which decreases the productivity of the worker and the quality of his work product. Furthermore, such prior art reinforcing strips are not inexpensive. Also, the corner formed by means of such prior art reinforcing strip, and especially for certain angles of corners is not optimally as sharp as the corner might be. Yet additionally, such prior art corner reinforcement strips are relatively expensive in the cost of manufacture, and in the costs, expenses and difficulties in utilization.

Based upon the above deficiencies, defects and difficulties with prior art corner reinforcement strips, it is a material object of the improved flexible corner bead strip of the present invention to materially alleviate such prior art problems.

A multiplicity of further advantages associated with use of the improved flexible corner bead strip of the present invention will become apparent to those of ordinary skill in the art upon review of the subsequent background of the invention, brief description of the drawing, detailed description of preferred embodiments, appended claims and accompanying drawings.

SUMMARY OF THE INVENTION

The improved flexible corner bead strip of the present invention is of the variety for reinforcing drywall corners and other corners requiring reinfircement. The present invention is directed to an improved flexible corner bead strip usable for reinforcing a drywall corner.

The corner bead strip hereof because of the cooperative nature of the elements thereof may be formed as a unitary device, but however comprises first and second plastic strips each if which has a substantial longitudinal dimension and corresponding with the length of the drywall corner to be reinforced.

Each of the first and second plastic strips also has a transverse dimension which defines a corner line formed from the respective central and abutting edges thereof. A flexible joint is disposed at the respective central and abutting edges of the first and second plastic strips forming a corner line, and may be formed of the same plastic material thereof. The corner line functions to substantially flexibly secure the first and second plastic strips together and permits the first and second plastic strips to be bent at an angle corresponding with the angle of the drywll corner for securement thereto, thereby to reinforce the drywall corner. An adhesive layer is also disposed on at least one side of the first and second plastic strips. A drywall compound adhering surface is also contained upon at least one side of the first and second plastic strips, and a side opposite an adhesive layered side in some embodiments.

The first and second plastic strips may comprise vinyl or other suitable plastics, and may have a transverse dimension of approximately at least one inch. Such improved flexible corner bead strip may be disposed into a rolled state for storage and packaging prior to use thereof.

BRIEF DESCRIPTION OF THE DRAWING

Various preferred embodiments of the improved flexible corner bead strip apparatus of the present invention are set forth in the accompanying drawing along with a comparison of the above disclosed and discussed prior art devices for clarity and emphasis of various advantages thereover, and in which:

FIG. 1 is a perspective view of the improved flexible corner bead strip of the present invention (shown in dotted lines) and as applied to a corner and showing drywall covering the first and second plastic strips defining a corner line from the respective central and abutting edges thereof to form a smooth and sharp-edged corner;

FIG. 2 is a perspective fragmented view of a prior art reinforcement strip showing two metallic (galvanized steel or aluminum) reinforcing strips disposed in side-by-side array on a paper or fabric carrier strip in parallel relation to each other and longitudinally of such carrier strip;

FIG. 3 is a further fragmented perspective view of the reinforcement strip of the prior art shown in disposition for application to a corner to be reinforced, and showing such metal reinforcing strips defining a corner reinforcement edge and depicting the opposite side of the carrier strip having a substantially smooth surface thereon for application of drywall compound hereto;

FIG. 4 ia a fragmented perspective view of the improved flexible corner bead strip of the present invention showing the first and second plastic strips disposed in side-by-side relationship prior to bending along the centrally disposed corner line thereof, to form an angle corresponding to that of the corner to be reinforced, and further showing disposed over the adhesive containing surface thereof a release sheet, which permits the side-by-side disposed first and second plastic strips to be rolled into a rolled format for packaging and storage prior to application thereof;

FIG. 5 is a greatly magnified and fragmented transverse cross-sectional view taken along line 5—5 of FIG. 1 and showing one embodiment of flexible joinder means disposed at the respective and central abutting edges as for forming the corner line for the substantially flexibly securing the first and second plastic strips together, and showing further an embodiment wherein mutually facing grooves are disposed on opposite sides of the corner line for defining a hinge such that the corner bead strip can be bent to accommodate either convex or concave corners; and FIG. 6 is a very greatly magnified transverse cross-sectional view taken along 6—6 of FIG. 1 and showing a drywall corner with the improved flexible corner bead strip of the present invention installed thereon and covered with drywall compound to form smooth, flat walls with a sharp corner therebetween.

DETAILED DESCRIPTION OF PREFERRED EMBODIMENTS

The improved flexible corner bead strip of the present invention is principally usable for reinforcing a drywall corner. The corner bead strip hereof comprises first and second plastic strips. Each of the first and second plastic strips has a substantial longitudinal dimension which corresponds with the length of the drywall corner to be reinforced, and may be cut to length from a storage roll of such material to so correspond. Each of the first and second plastic strips has a transverse dimension which defines a corner line formed from the respective central and abutting edges of each of the first and second plastic strips.

A flexible joinder means in the form in some preferred embodiments of a hinge is disposed at the respective central and abutting edges forming the corner line. The flexible joinder means functions to substantially flexibly secure the first and second plastic strips together, and also permits each of the first and second plastic strips to be bent at a selected angle corresponding to the angle of the drywall corner for securement thereto to reinforce the drywall corner.

Adhesive means are disposed on at least one side of the first and second plastic strips for permitting application thereof to the drywall corner to be reinforced and for adhesion of such corner bead strip thereto.

Drywall compound adhering surface means are disposed upon at least one of the first and second plastic strips for adhesion of the drywall compound to the exposed surface in situ of the first and second plastic strips. Thus, the improved flexible corner bead strip of the present invention functions whereby the drywall corner may be readily, stabily and securely reinforced regardless of the angle of the corner.

In preferred embodiments of improved flexible corner bead strip of the present invention, the first and second pastic strips may be formed from a vinyl plastic.

Also in alternative preferred embodiments, such first and second plastic strips may be formed from a polypropolyene polymer, or other plastic having substantial rigidity, to function for forming a corner bead structure to hold and support the drywall surfaces.

In these and other preferred embodiments, the flexible joinder means may comprise a plastic hinge which may be-co-extruded, co-molded, or otherwise co-formed with the rigid polymeric material used for forming the plastic strips. This polymeric material used for forming the polymeric material having substantial flexibility in both lateral directions to function as a hinge, and may be formed of ethylene vinyl acetate polymer (EVA) or other such substantially flexible polymeric materials.

In alternative embodiments, other plastics having appropriate properties of flexibility, strength and stability may be utilized. These selected plastics may be determined by those of ordinary skill in the art without undue experimentation.

In these and other preferred embodiments, the first and second plastic strips each have a transverse dimension which may be approximately at least one inch.

The flexible joinder means of the improved flexible corner bead strip of the present invention may comprise a weakening in the plastic material of the first and second plastic strips corresponding to the corner line, thereby to permit a fold along such corner line.

Such flexible joinder means may comprise a corner groove disposed within at least one surface of the first and second plastic strips corresponding to the corner line. A supplemental groove means may be disposed at and along the corner line and in the surface on the opposite side from the corner groove for providing supplemental flexibility to the flexible joinder means. Such flexible joinder means may comprise means for substantially flexibly bending in both directions and for accommodation of both convex and concave corners.

Such flexible joinder means or hinge means may comprise at least one corner slit cut into the surface of the plastic material of the first and second plastic strips to define a corner line thereof. Such corner slit may be preferably cut into the surface of the plastic material for a substantial depth, but in preferred embodiments not all the way through such plastic material. In yet further alternative embodiments, such slit may be discontinuous in the form of a dotted line or scoring.

The drywall compound adhering surface means of the improved flexible corner bead strip of the present invention may preferably comprise a plurality of drywall compound receiving and adhering elements disposed within the first and second plastic strips. Such drywall compound receiving and adhering elements may in preferred embodiments comprise apertures disposed within and/or through the first and second plastic strips. Such apertures may be molded in, or in preferred embodiments may be stamped into the plastic material.

The adhesive means of the improved flexible corner bead strip of the present invention are preferably disposed upon a first side of the first and second plastic strips. In these and other embodiments, the drywall compound adhering surface may be disposed upon the opposite side of the first and second plastic strips.

In other embodiments, the adhesive means may be disposed upon both sides of the first and second plastic strips, and in such embodiments and other embodiments the flexible joinder means may be disposed for substantial flexing of the first and second plastic strips towards each other and in one direction only. In these embodiments the selection of such first and second plastic strips towards each other are at angles of between approximately 0° through 180°, but not in the opposite direction and between the angles of approximately 181°-360°. In such embodiments, the corner bead strip may be used for convex and or concave corners by selecting either side for disposition onto the corner surface for reinforcement thereof.

In some preferred embodiments, release sheet means aro provided for releasably and protectively disposing upon and over the adhesive means and to be peeled off prior to application of the corner bead strip to the corner to be reinforced.

In preferred embodiments of the improved flexible corner bead strip of the present invention the first and second plastic strips are maintained in side-by-side disposition and the length of the first and second strips is further disposed into a rolled state for storage prior to use thereof.

Referring now to the drawing and to FIGS. 2 and 3 in particular, a prior art reinforcement strip generally 10 is depicted, in the flat storage format in FIG. 2, and in the bent format, as in situ, in FIG. 3 as shown in FIG. 2. Such prior art reinforcement strip 10 comprises two metallic reinforcing strips 12,14 formed of substantially non-corroding material such as stainless steel or aluminum. Such metallic reinforcing strips 12,14 disposed separated by a substantially uniform space 13, and in side-by-side array and substantially parallel upon and generally longitudinally of carrier strip 16 which may be formed of paper or fabric. In FIG. 3, of such prior art reinforcing strip 10 is shown in position for application to a corner to be reinforced (not shown). Such metallic reinforcing strips 12,14 define a corner reinforcement edge 18. Such carrier strip 16 is shown to have a substantially smooth rear surface 20 thereof for ready application of drywall compound thereto (not shown).

As shown in FIGS. 1, 4, 5 and 6, the improved flexible corner bead strip of the present invention generally 22 is principally usable for reinforcing a drywall corner 24, as shown in the perspective view of FIG. 1. Such drywall corner 24 is formed form walls 26,28 and is disposed between ceiling 30 and floor 32, and my be equipped with woodwork trim 34.

The corner bead strip 22 hereof comprises first and second plastic strips 36,38. As shown in FIG. 4 each of first and second plastic strips 36,38 has a substantial longitudinal dimension which corresponds with the length of the drywall corner 24 to be reinforced as shown in FIG. 1. Such improved flexible corner head strip 22 hereof may be cut to length from a storage roll of such material to so correspond, it being noted that the flexible corner bead strip as shown in FIG. 4 is rollable. Each of first and second plastic strips 36,38 has a transverse dimension 40,42 which defines a corner line generally 44 formed form the respective central and abutting edges 46,48 of each of first and second plastic strips 36,38.

As shown in FIG. 6, a flexible joinder means in the form in some preferred embodiments of a hinge 50 is disposed at the respective central and abutting edges 46,48 forming corner line 44. The flexible joinder means functions to substantially flexibly secure first and second plastic strips 36,38 together, and also permits each of first and second plastic strips 36,38 to be bent at a selected angle corresponding to the angle of the drywall corner for securement thereto to reinforce drywall corner 24, as shown in FIG. 6. Adhesive means 52 are disposed on at least one side 54 of first and second plastic strips 36,38 for permitting application thereof to drywall corner 24 to be reinforced and for adhesion of such corner bead strip 22 thereto. Drywall compound adhering surface means are disposed upon at least one of first and second plastic strips 36,38, for adhesion of the drywall compound to the exposed surface in situ of first and second plastic strips 36,38. Thus, the improved flexible corner bead strip 22 of the present invention functions whereby drywall corner 24 may be readily, stabily and securely reinforced regardless of the angle of the corner.

In preferred embodiments of improved flexible corner bead strip 22 of the present invention, such first and second plastic strips 36,38 may be formed from a vinyl plastic. In alternative embodiments, other plastics having appropriate properties of flexibility, strength and stability may be utilized. These selected plastics may be delermined by those of ordinary skill in the art without undue experimentation.

As shown schematically in FIG. 1, in these and other preferred embodiments, first and second plastic strips 36,38 each have a transverse dimension which may be approximately at least one inch.

The flexible joinder means of the improved flexible corner bead strip of the present invention may comprise a weakening in the plastic material of first and second plastic strips 36,38 corresponding to the corner line 44, thereby to permit a fold along such corner line 44.

As shown in FIG. 5 in particular, such flexible joinder means may comprise a corner groove 56 which may be formed of a second polymeric material, and is disposed within at least one surface 55 of first and second plastic strips 36,38 corresponding to corner line 44. A supplemental groove 58 may be disposed at and along corner line 44 and in the surface 54 on the opposite side from corner groove 56 for providing supplemental flexibility to the flexible joinder means. Such flexible joinder means may comprise means for substantially flexibly bending in both directions and for accommodation of both convex and concave corners.

Such flexible joinder means or hinge means may comprise at least one corner slit 60 cut into surface 54 of the plastic material of first and second plastic strips 36,38 to define a corner line thereof. Such corner slit 60 may be preferably cut into the surface of the plastic material for a substantial depth, but in preferred embodiments not all the way through such plastic material. In yet further alternative embodiments, such slit 60 may be discontinuous in the form of a dotted line or scoring.

The drywall compound adhering surface means of the improved flexible corner bead strip of the present invention may preferably comprise a plurality of drywall compound receiving and adhering elements disposed within first and second pastic strips 36,38. More particularly, such drywall compound receiving and adhering elements may in preferred embodiments comprise apertures 62 disposed within and/or through first and second plastic strips 36,38. Such apertures 62 may be molded in, or in preferred embodiments may be stamped into the plastic material.

The adhesive 52 of the improved flexible corner bead strip 22 of the present invention is preferably disposed upon a first side 54 of first and second plastic strips 36,38. In these and other embodiments, the drywall compound adhering surface 55 may be disposed upon the opposite side of first and second plastic strips 36,38.

In other embodiments, the adhesive 52 may be disposed upon both sides 54,55 of first and second plastic strips 36,38, and in such embodiments and other embodiments the flexible joinder means 56 may be disposed for substantial flexing of first and second plastic strips 36,38 towards each other and in one direction only. In these embodiments, the disposition when installed of such first and second plastic strips 36,38 towards each other is at angles of between approximately 0° through 180°, but not in the opposite direction and between the angles of approximately 181°–360°. In such embodiments, corner bead strip 22 hereof may be used for convex and or concave corners by selecting either side for disposition onto corner 24 for reinforcement thereof.

In some preferred embodiments, release sheet means 64 are provided for releasably and protectively disposing upon and over the adhesive 52 and to be peeled off prior to application of corner bead strip 22 to the corner 24 to be reinforced.

In prefferred embodiments of the improved flexible corner bead strip 22 of the present invention first and second plastic strips 36,38 are maintained in side-by-side disposition and the length of first and second strips 36,38 is further disposed into a rolled state for storage prior to use thereof.

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. An improved flexible corner bead strip for reinforcing a dry wall corner, said corner bead strip comprising:

first and second plastic strips, each having a substantial longitudinal dimension corresponding with the length of the dry wall corner to be reinforced, and each having a transverse dimension defining a corner line formed from the respective central and abutting edges of each of said first and second plastic strips, said first and second plastic strips formed from a first polymeric material having substantial rigidity;

flexible joinder means disposed at said respective central and abutting edges forming said corner line for substantially flexibly securing said first and second plastic strips together and for permitting each of said first and second plastic strips to be bent at a selected angle corresponding to the angle of said dry wall corner for securement thereto to reinforce said dry wall corner, said flexible joinder means comprising a plastic hinge formed from a second polymeric material having substantial flexibility in both lateral directions;

adhesive means disposed upon at least one side of said first and second plastic strips for permitting application thereof to the corner to be reinforced and for adhesion thereto; and dry wall compound adhering surface means disposed upon at least one of said first and second plastic strips for adhesion of the dry wall compound to the exposed surface in situ of said first and second plastic strips, whereby the dry wall corner may readily, stabily and securely be reinforced substantially independently of and regardless of the angle of such corner.

2. The improved flexible corner bead strip of claim 1 wherein said first and second plastic strips comprise a vinyl plastic.

3. The improved flexible corner bead strip of claim 1 wherein said first and second plastic strips each have a transverse dimension of approximately at least 1 inch.

4. The improved flexible corner bead strip of claim 1 wherein said flexible joinder means comprises means for substantially flexibly bending in both directions and for accommodating both convex and concave corners.

5. The improved flexible corner bead strip of claim 1 wherein said flexible joinder means commprises at least one corner slit cut into the surface of the plastic material of said first and second plastic strips to a substantial depth to define the corner line thereof.

6. The improved flexible corner bead strip of claim 1 wherein said adhesive means is disposed upon a first side of said first and second plastic strips.

7. The improved flexible corner bead strip of claim 1 wherein said dry wall compound adhering surface is disposed upon the second side of said first and second plastic strips.

8. The improved flexible corner bead strip of claim 1 wherein said adhesive means is disposed upon both sides of said first and second plastic strips.

9. The improved flexible corner bead strip of claim 1 wherein said flexible joinder means is disposed for substantial flexing of said first and second plastic strips towards each other in one direction only and between the angles of approximately 0°–180°, but not in the opposite direction and between the angles of approximately 181°–360°, whereby the corner bead strip may be used for convex or concave corners by selecting either side for disposition onto the corner surface for reinforcement thereof.

10. The improved flexible corner bead strip of claim 1 further comprising release sheet means for releasable and protective disposition upon and over said adhesive means and for peeling off, prior to application of the corner head strip to the corner to be reinforced.

11. The improved flexible corner bead strip of claim 1 wherein prior to use thereof said first and second plastic strips are maintained in side-by-side disposition and the length of said first and second strips is further disposed into a rolled state for storage prior to use thereof.

12. The improved flexible corner bead strip of claim 1 wherein said first polymeric material having substantial rigidity comprises polypropylene.

13. The improved flexible corner bead strip of claim 1 wherein said second polymeric material having substantial flexibility in both lateral directions comprises ethylene vinyl acetate.

14. The improved flexible corner bead strip of claim 1 wherein said flexible joinder means comprises a corner groove disposed within at least one surface of said first and second plastic strips corresponding to said corner line.

15. The improved flexible corner bead strip of claim 14 further comprising supplemental groove means disposed at and along said corner line and in the surface on the opposite side from said corner groove for providing supplemental flexibility to said flexible joinder means.

16. The improved flexible corner bead strip of claim 1 wherein said dry wall compound adhering surface means comprises a plurality of dry wall compound receiving and adhereing elements disposed within said first and second plastic strips.

17. The improved flexible corner bead strip of claim 16 wherein said drywall compound receiving and adhering elements comprise apertures disposed within and through said first and second plastic strips.

* * * * *